US010022850B2

(12) United States Patent
Lee et al.

(10) Patent No.: US 10,022,850 B2
(45) Date of Patent: Jul. 17, 2018

(54) STEPLESS VARIABLE AUTO STROKE HYDRAULIC BREAKER SYSTEM

(71) Applicant: DAEMO ENGINEERING CO., LTD., Siheung-si, Gyeonggi-do (KR)

(72) Inventors: Won Hae Lee, Pyeongtaek-si (KR); Hak Kyu Kim, Ansan-si (KR)

(73) Assignee: DAEMO ENGINEERING CO., LTD., Siheung-si, Gyeonggi-Do (KR)

( * ) Notice: Subject to any disclaimer, the term of this patent is extended or adjusted under 35 U.S.C. 154(b) by 371 days.

(21) Appl. No.: 14/813,004

(22) Filed: Jul. 29, 2015

(65) Prior Publication Data

US 2016/0279775 A1 Sep. 29, 2016

(30) Foreign Application Priority Data

Jul. 30, 2014 (KR) ..... 10-2014-0097411

(51) Int. Cl.
*B25D 9/26* (2006.01)
*B25D 9/12* (2006.01)
*E21C 31/02* (2006.01)

(52) U.S. Cl.
CPC ..... *B25D 9/265* (2013.01); *B25D 9/12* (2013.01); *B25D 9/26* (2013.01); *E21C 31/02* (2013.01); *B25D 2250/221* (2013.01)

(58) Field of Classification Search
CPC . B25D 9/265; B25D 9/12; B25D 9/14; B25D 9/26; B25D 2250/221; E21C 31/02
(Continued)

(56) References Cited

U.S. PATENT DOCUMENTS 5,174,387 A 12/1992 Arndt et al.
5,860,481 A * 1/1999 Prokop ..... B25D 9/14 173/17

(Continued)

FOREIGN PATENT DOCUMENTS

GB 2485276 5/2012
JP 2001017873 1/2001

(Continued)

OTHER PUBLICATIONS

RU Office Action dated Oct. 27, 2016 as received in Application No. 2015131641.

(Continued)

*Primary Examiner* — Michelle Lopez
(74) *Attorney, Agent, or Firm* — Rabin & Berdo, P.C.

(57) ABSTRACT

Provided is a stepless variable auto stroke hydraulic breaker system capable of reducing impact energy reflected in the event of an idle blow by detecting a frequency of vibrations generated when a chisel breaks objects such as bedrocks using a vibration sensor, operating according to a short stroke if the frequency of vibrations does not exceed a preset frequency, and automatically switching the short stroke into a long stroke if the frequency of vibrations exceeds the preset frequency. The breaker system includes a vibration sensor configured to detect vibrations generated when a chisel breaks rocks, a transmitter provided with the vibration sensor and configured to transmit signals generated from the vibration sensor, a receiver configured to receive the signals transmitted from the transmitter, and a stepless variable auto stroke hydraulic breaker controlled by a reception micro controller unit (MCU) of the receiver.

4 Claims, 7 Drawing Sheets

(58) Field of Classification Search
USPC ..... 173/200
See application file for complete search history.

(56) References Cited

U.S. PATENT DOCUMENTS

| | | | | |
|---|---|---|---|---|
| 6,087,936 | A | 7/2000 | Woods | |
| 7,410,010 | B2 | 8/2008 | Henriksson et al. | |
| 8,228,191 | B2 | 7/2012 | Woods | |
| 2007/0074881 | A1* | 4/2007 | Bermingham ..... | E02D 7/02 173/2 |
| 2008/0296035 | A1 | 12/2008 | Lohmann et al. | |
| 2012/0250815 | A1 | 10/2012 | Oksman et al. | |

FOREIGN PATENT DOCUMENTS

| | | | |
|---|---|---|---|
| JP | 2004289083 | | 10/2004 |
| JP | 2008506543 | | 3/2008 |
| KR | 1020090041823 | | 4/2009 |
| KR | 1020120104300 | | 9/2012 |
| KR | 10-1285062 | B1 | 7/2013 |
| SU | 188930 | A1 | 11/1966 |
| SU | 1104265 | A | 7/1984 |
| WO | 2006/022584 | A1 | 3/2006 |

OTHER PUBLICATIONS

Office Action dated Nov. 13, 2015 by Korean Intellectual Property Office.
European Search Report dated Jan. 4, 2016 by European Patent Office.
Notice of Allowance dated May 17, 2016 by Korean Intellectual Property Office.
Office Action dated Jun. 21, 2016 by Japanese Patent Office.

* cited by examiner

STEPLESS VARIABLE AUTO STROKE HYDRAULIC BREAKER SYSTEM

CROSS-REFERENCE TO RELATED APPLICATION

This application claims the benefit under 35 U.S.C. § 119(a) of Korean Patent Application No. 2014-0097411, filed on Jul. 30, 2014, the disclosure of which is incorporated by reference in its entirety for all purposes.

BACKGROUND

1. Field

The present invention relates to a stepless variable auto stroke hydraulic breaker system and, more particularly, to a stepless variable auto stroke hydraulic breaker system capable of reducing impact energy reflected in the event of an idle blow by detecting, via a vibration sensor, a frequency or the number of vibrations generated when a chisel breaks objects such as bedrocks, operating with a short stroke if the frequency or the number of vibrations does not exceed a preset frequency or a preset number, and automatically switching the short stroke into a long stroke if the frequency or the number of vibrations exceeds the preset frequency or the preset number.

2. Description of the Related Art

In general, hydraulic breakers are used to break up rocks. Such a hydraulic breaker includes a housing that has a reciprocating piston controlled by a distribution valve and a cylinder bore, and a pressure accumulator. While the hydraulic breaker is in operation, the pressure accumulator is preliminarily pressurized to a pre-load pressure in order to prevent the hydraulic breaker from being damaged by a fluid cavity and a pressure gradient and increase performance of the hydraulic breaker, and transmits a blow to a chisel from the piston. Thereby, a chisel tip supplied with kinetic energy of the piston breaks a rock.

In the case of a rock composed of soft substances, energy remaining after the rock is broken is applied to components of the hydraulic breaker.

Therefore, a process in which applied kinetic energy is greater than energy required to break the rock is not desirable, because high stress occurs at the hydraulic breaker due to the energy remaining after the rock is broken. Thus, applying a rapid change in the kinetic energy to all operating conditions prolongs a life of the hydraulic breaker and is simultaneously an important requirement for optimal material breaking.

However, the conventional hydraulic breakers are driven before a supplied hydraulic pressure reaches a level higher than or equal to the pre-load pressure of the pressure accumulator, or are continuously driven after the supplied hydraulic pressure is reduced below the pre-load pressure of the pressure accumulator. That is, the pressure accumulator cannot be operated with precision. In detail, the pressure accumulator cannot absorb an undesired pressure gradient, cannot prevent a cavity in a hydraulic fluid, and cannot increase a flow of the fluid during an operating stroke of the piston. Therefore, there is a serious risk of certain portions of the impact mechanism being damaged.

To solve this problem, Korean Patent No. 10-1285062 has been proposed.

The preceding patent includes a housing 10 with a cylinder bore 11, a forward working chamber 23 and a rear working chamber 18, a hydraulic fluid supply passage 26 continuously connected to the forward working chamber 23 and a drain passage 33 connected to the rear working chamber 18, a hammer piston 12 reciprocally guided in the cylinder bore 11 in order to deliver hammer blows to a working implement 14 attached to the housing 10, a pressure accumulator 27 pre-loaded to a certain pressure level, and a distribution valve 30 for alternatingly connecting the rear working chamber 18 to the drain passage 33 and the supply passage 26 to thereby reciprocate the hammer piston 12, wherein a sequence valve 34 is provided in the drain passage 33 for the purpose of keeping the pressure in the rear working chamber 18 at such a level that the resulting forward directed force will prevent the piston 12 from being moved backward in the cylinder bore 11 at pressure levels in the supply passage 26 below the pre-load pressure level of the accumulator 27. Thereby, impact energy according to an idle blow is reduced.

However, the preceding patent has a problem in that it is still insufficient to reduce the reflected impact energy according to the idle blow.

PRIOR ART DOCUMENT

Patent Document

[Patent Document 1] Korean Patent No. 10-1285062 titled "HYDRAULIC IMPACT MECHANISM" (registered on Jul. 4, 2013).

SUMMARY

Accordingly, an object of the present invention is to provide a stepless variable auto stroke hydraulic breaker system in which a vibration sensor detects vibrations generated when a chisel breaks rocks and converts the detected vibrations into signals, a counter counts a frequency or the number of the vibrations corresponding to the generated signals, and thereby, according to the frequency or the number of the vibrations counted for a predetermined time, a stroke of a piston can be automatically adjusted from a short stroke to a long stroke, and vice versa.

In order to achieve the above object, according to an aspect of the present invention, there is provided a stepless variable auto stroke hydraulic breaker system, which includes: a vibration sensor configured to detect vibrations generated when a chisel breaks rocks; a transmitter provided with the vibration sensor and configured to transmit signals generated from the vibration sensor; a receiver configured to receive the signals transmitted from the transmitter; and a stepless variable auto stroke hydraulic breaker controlled by a reception micro controller unit (MCU) of the receiver.

As described above, in the stepless variable auto stroke hydraulic breaker system according to the present invention, according to the number of blows of the chisel, the piston is freely switched between a short stroke and a long stroke. Thus, due to the switching of the strokes, work efficiency is improved.

Further, as the stroke is shortened in the event of an idle blow, the remaining impact energy is reduced, and a life of the hydraulic breaker is increased.

BRIEF DESCRIPTION OF THE DRAWINGS

The above and other features of the present invention will be described in reference to specific exemplary embodiments thereof with reference to the attached drawings in which.

DETAILED DESCRIPTION

Figure 1:
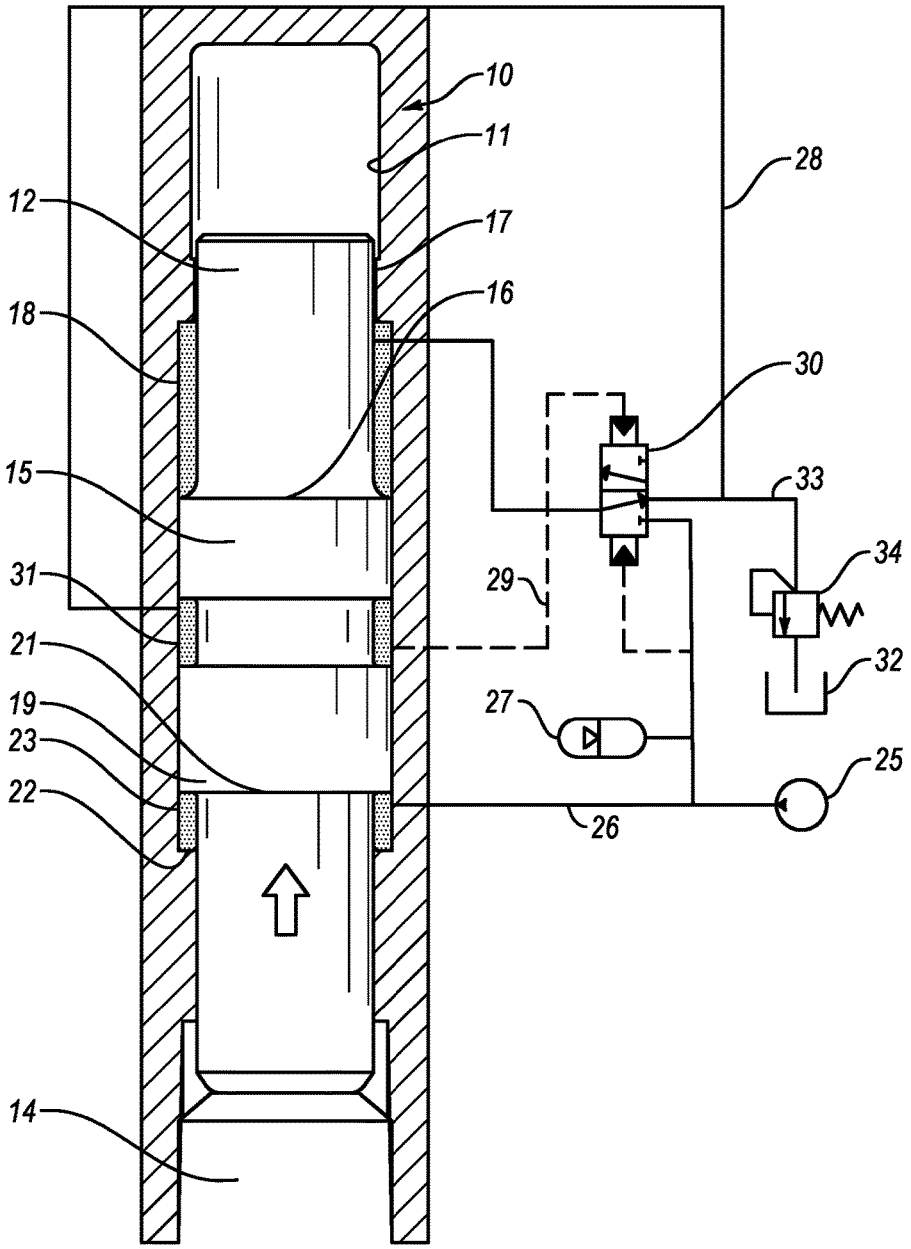
FIG. 1 is a diagram schematically illustrating a conventional hydraulic impact mechanism.

Hereinafter, a stepless variable auto stroke hydraulic breaker system according to an embodiment of the present invention will be described in greater detail with reference to the accompanying drawings. When the detailed descriptions of known functions and configurations are determined as unnecessarily obscuring the subject matter of the present invention, they will be omitted. Technical terms, as will be described below, are terms defined in consideration of their functions in the present invention, which may be varied according to the intention or usual practice of a client, an operator, or a user, or the like, so that the terms should be defined based on the overall content of this specification.

Throughout the drawings, the same reference numerals are used to indicate the same components.

Figure 2:
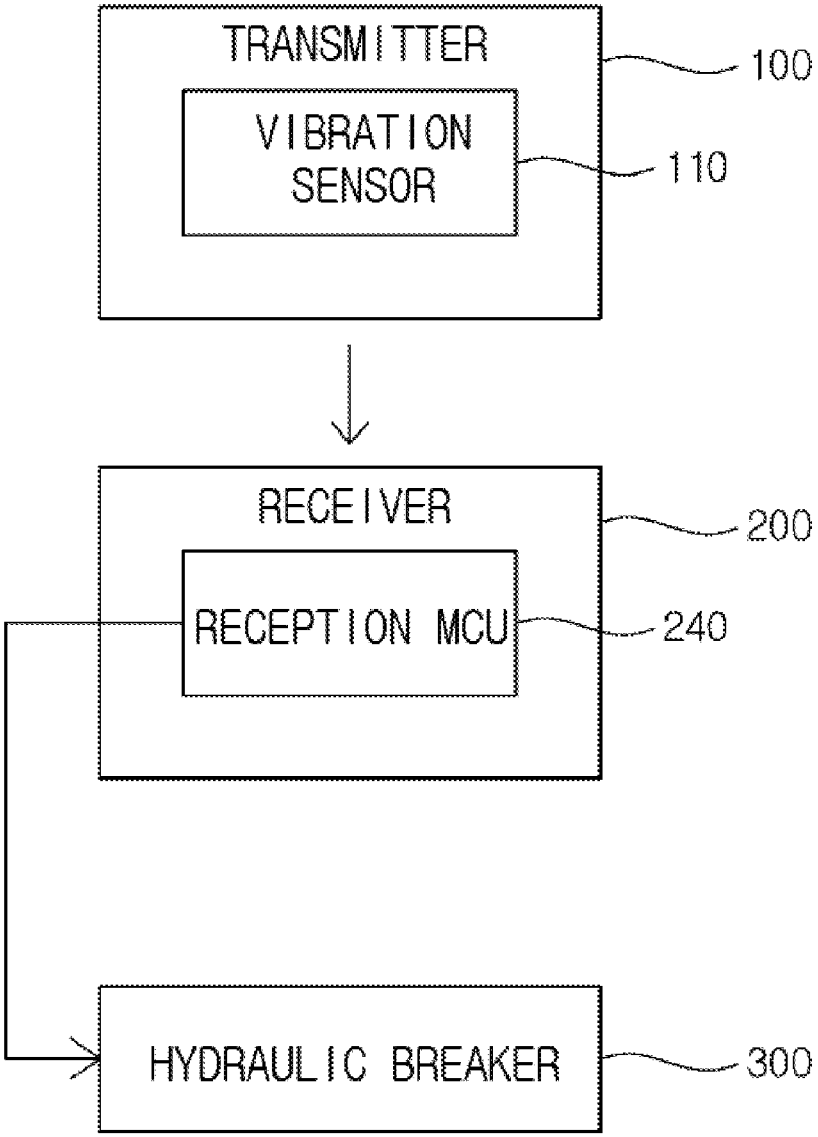
FIG. 2 is a schematic configuration block diagram of a stepless variable auto stroke hydraulic breaker system according to the present invention.
Figure 3:
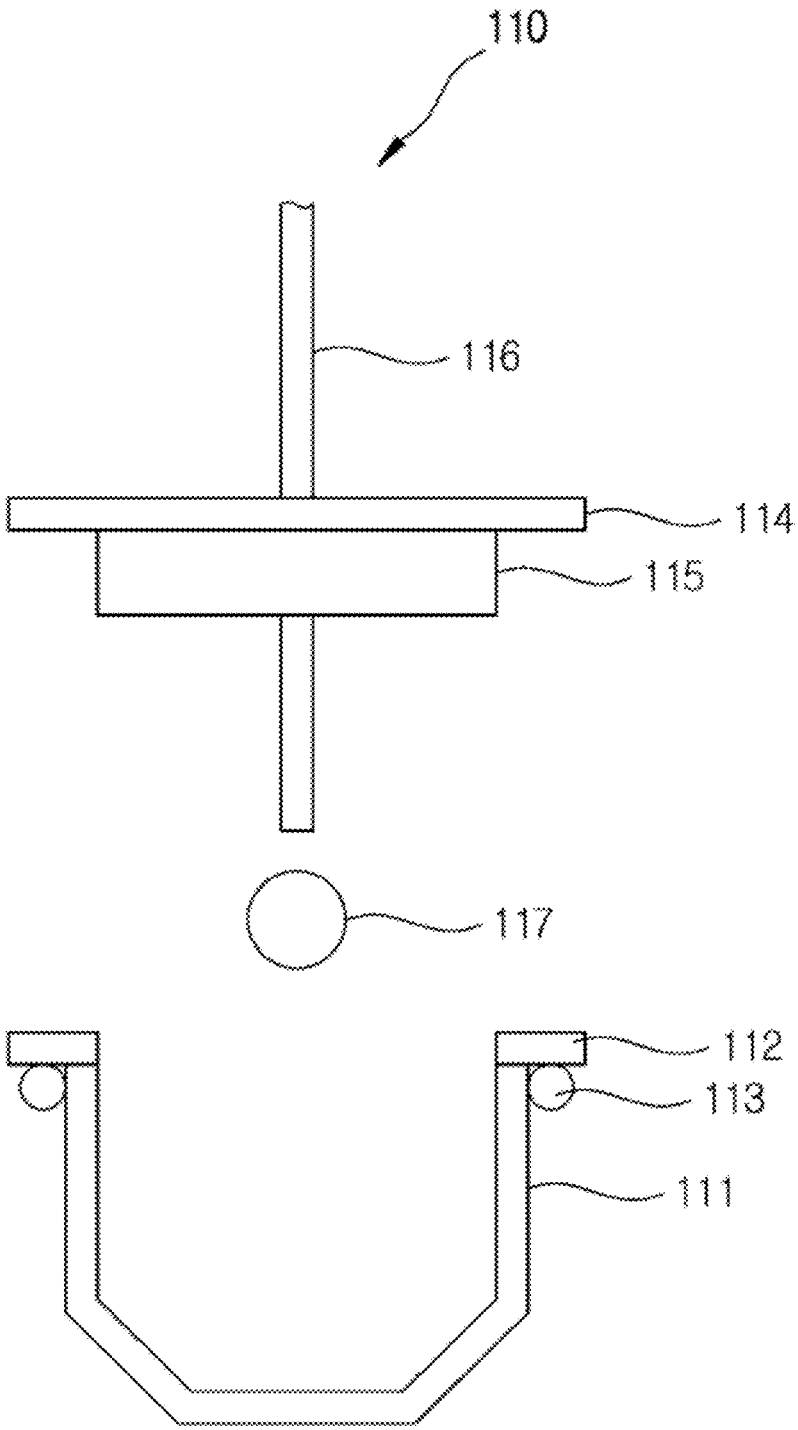
FIG. 3 is a detailed configuration diagram of the vibration sensor of FIG. 2.
Figure 4A:
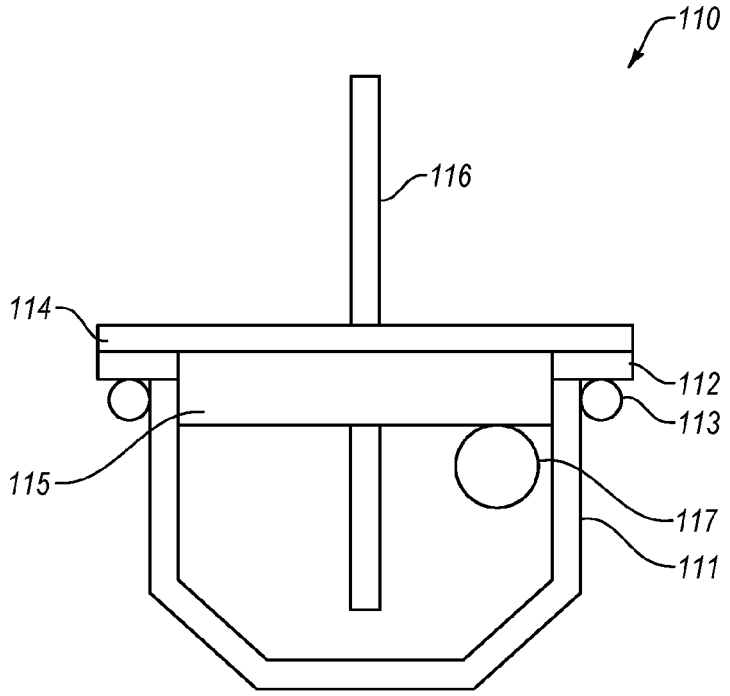
FIGS. 4A and 4B illustrate a working state of the vibration sensor of FIG. 3.
Figure 4B:
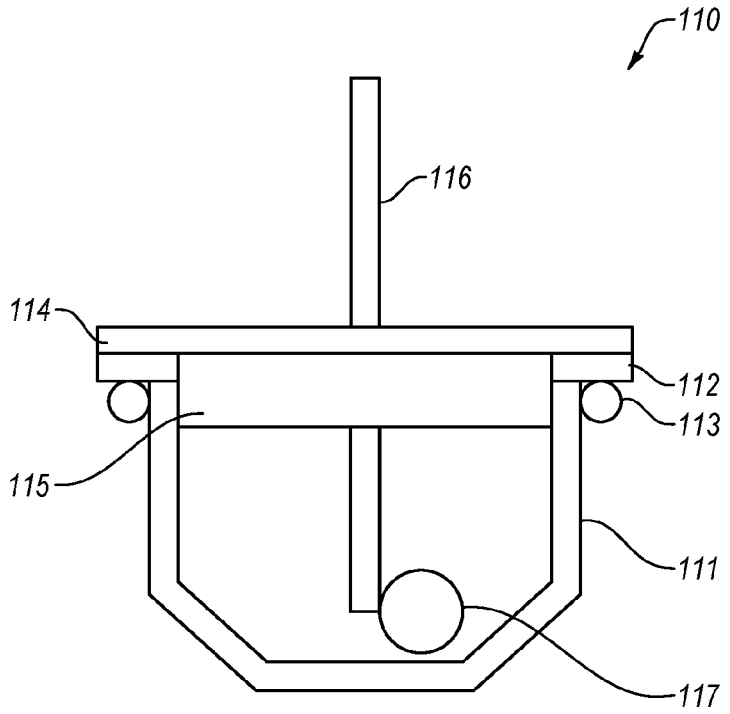
Figure 5:
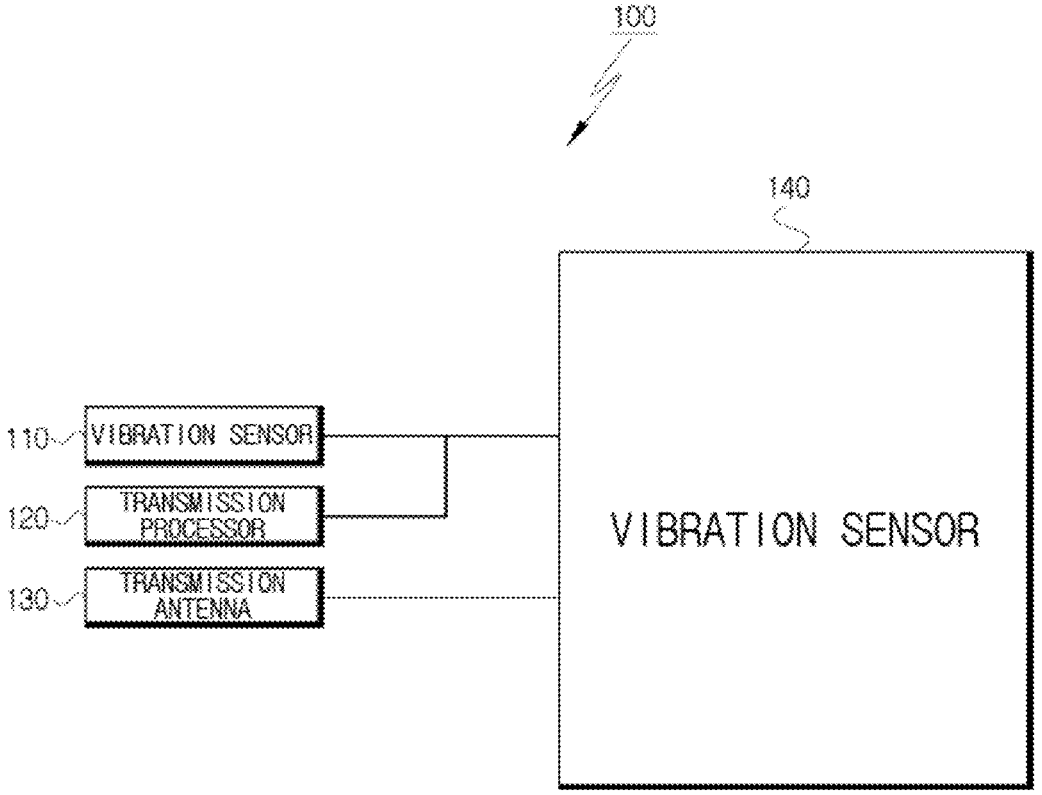
FIG. 5 is a configuration block diagram of a transmitter for transmitting a signal detected by the vibration sensor.
Figure 6:
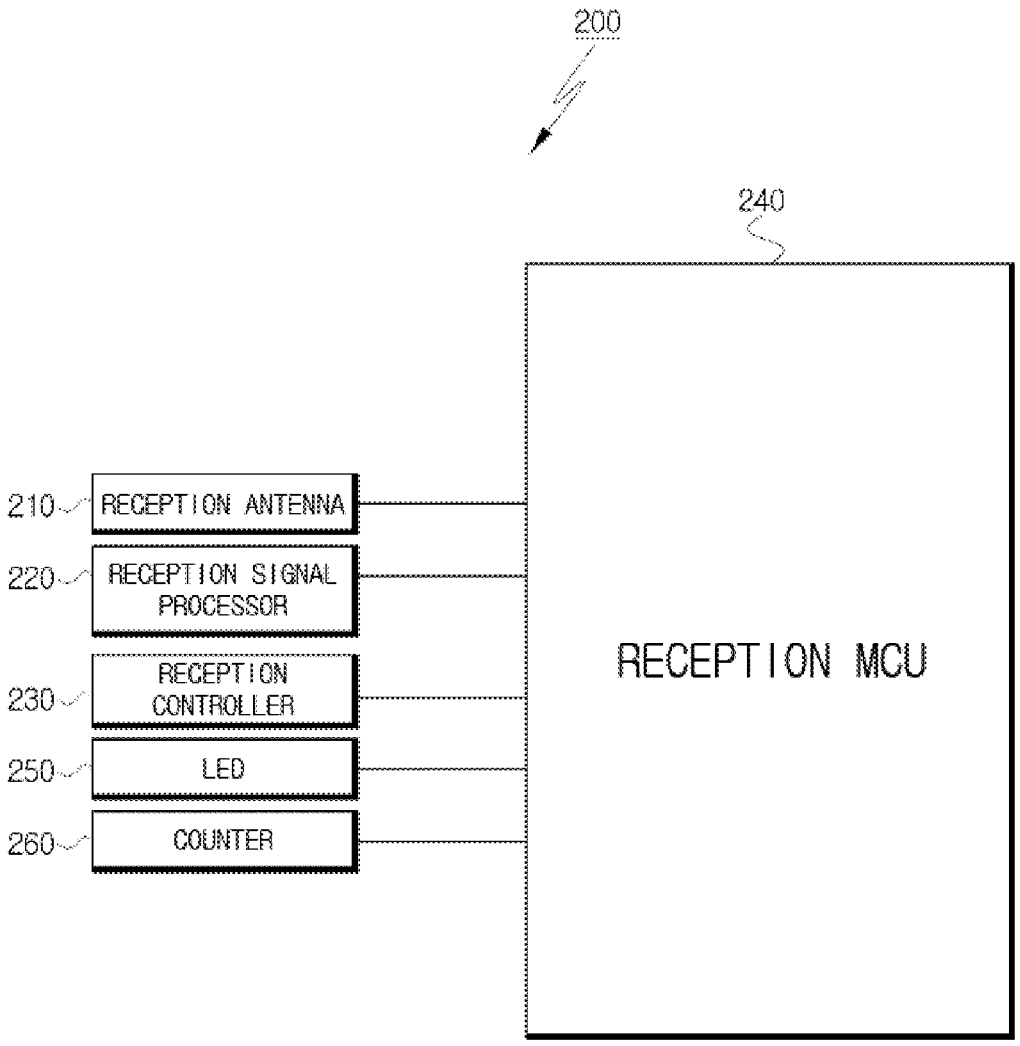
FIG. 6 is a configuration block diagram of a receiver for receiving a signal detected by the vibration sensor.
Figure 7:
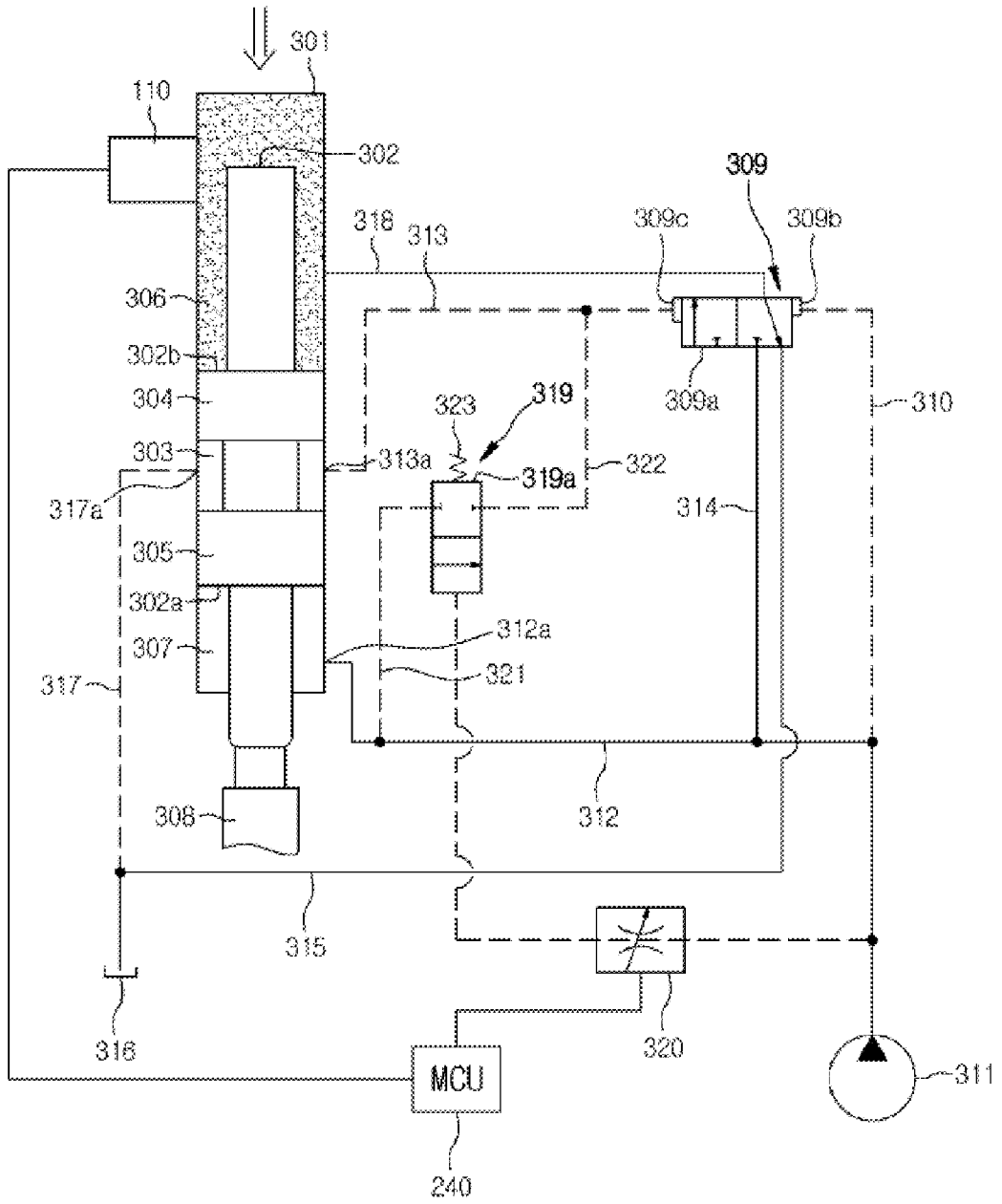
FIG. 7 illustrates a hydraulic impact mechanism of the stepless variable auto stroke hydraulic breaker system according to the present invention.

FIG. 2 is a schematic configuration block diagram of a stepless variable auto stroke hydraulic breaker system according to the present invention. FIG. 3 is a detailed configuration diagram of the vibration sensor of FIG. 2. FIGS. 4A and 4B illustrate a working state of the vibration sensor of FIG. 3. FIG. 5 is a configuration block diagram of a transmitter for transmitting a signal detected by the vibration sensor. FIG. 6 is a configuration block diagram of a receiver for receiving a signal detected by the vibration sensor. FIG. 7 illustrates a hydraulic impact mechanism of the stepless variable auto stroke hydraulic breaker system according to the present invention.

As illustrated in FIGS. 2 to 7, a stepless variable auto stroke hydraulic breaker system according to the present invention includes a vibration sensor 110 that detects vibrations generated when a chisel 308 breaks rocks, a transmitter 100 that is provided with the vibration sensor 110 and transmits signals generated from the vibration sensor 110, a receiver 200 that receives the signals transmitted by the transmitter 100 and is provided with a reception micro controller unit (MCU) 240, and a stepless variable auto stroke hydraulic breaker 300 that is provided with a hydraulic impact mechanism controlled by the reception MCU 240 of the receiver 200.

Here, the transmitter 100 is made up of the vibration sensor 110, a transmission signal processor 120 for processing the signal generated by the vibration sensor 110 into a transmission signal, a transmission antenna 130 for transmitting the transmission signal processed by the transmission signal processor 120, and a transmission MCU 140 for controlling an operation of the transmission signal processor 120 and an operation of the transmission antenna 130.

In an operation of the transmitter 100 configured in this way, the signal generated by the vibration sensor 110 is processed into the transmission signal at the transmission signal processor 120, and the transmission antenna 130 transmits the processed transmission signal to the receiver 200 to be described below. At this time, the transmission MCU 140 controls the operations of the transmission signal processor 120 and the transmission antenna 130. The situation controlled in this way is transmitted to the receiver 200 (to be described below) to the transmission antenna 130. The transmitter 100 is mounted on an attachment, and is operated by a battery or a solar cell.

Further, the vibration sensor 110 is made up of a housing 111 that is formed of a metal, a protrusion 112 that is formed at an upper end of the housing 111, a pair of iron-magnet bias elements 113 that are mounted under the protrusion 112 and provide an electronic element with a predetermined operating point, a metal cap 114 that covers an upper portion of the housing 111, a ceramic insulator 115 that is mounted under the metal cap 114 and adjusts a magnetic field between a magnetic sphere 117 and the metal cap 114, a metal electrode 116 that passes through the metal cap 114 and the ceramic insulator 115 to be housed in the housing 111, and the magnetic sphere 117 that is contacted with or separated from the metal electrode 116 to thereby generate a signal and has magnetism.

When a vibration is generated by an operation of the chisel 308, the vibration sensor 110 configured in this way generates a signal in such a manner that the magnetic sphere 117 attached to the ceramic insulator 115 mounted under the metal cap 114 by the magnetic field between the metal cap 114 and the magnetic sphere 117 is detached from the ceramic insulator 115 by the vibration and is contacted with the metal electrode 116 housed in the housing 111. That is, when the magnetic sphere 117 is connected to the metal electrode 116, the signal is generated. When the magnetic sphere 117 is disconnected from the metal electrode 116, no signal is generated. Therefore, the magnetic sphere 117 is connected to or disconnected from the metal electrode 116 according to the vibration caused by the operation of the chisel 308, and thereby serves as a switch that generates signals at certain intervals. As a result, a frequency or the number of working strokes of a piston 302 of the stepless variable auto stroke hydraulic breaker 300 can be measured. The signals generated in this way are transmitted to the receiver 200 through the transmission antenna 130 via the transmission signal processor 120 of the transmitter 100 under the control of the transmission MCU 140.

Further, the receiver 200 is made up of a reception antenna 210 that receives the transmission signal transmitted by the transmission antenna 130 of the transmitter 100, a reception signal processor 220 that processes the transmission signal received by the reception antenna 210 into a reception signal, a reception controller 230 that transmits the signal processed by the reception signal processor 220 to a reception MCU 240, a light-emitting diode (LED) 250 that emits light to inform an operator of the stepless variable auto stroke hydraulic breaker 300 of the situation received by the reception controller 230, a counter 260 that counts the vibrations of the vibration sensor 110 under the control of the reception MCU 240, and the reception MCU 240 that controls operations of the reception antenna 210, the reception signal processor 220, the reception controller 230, the LED 250, and the counter 260 and controls a hydraulic impact mechanism of the stepless variable auto stroke hydraulic breaker 300.

In the receiver 200 configured in this way, the reception antenna 210 of the receiver 200 receives the transmission signal transmitted through the transmission antenna 130 of the transmitter 100, and the reception signal processor 220 processes the received transmission signal into a reception signal. The reception controller 230 transmits the processed reception signal to the reception MCU 240, and the reception MCU 240 informs the operator of the stepless variable auto stroke hydraulic breaker 300 of this situation using the light emitted from the LED 250. Thereby, the operator recognizes a present state of the working stroke. The receiver 200 is mounted on a cabin (not shown), is supplied with power, and is operated.

Hereinafter, the hydraulic impact mechanism of the stepless variable auto stroke hydraulic breaker 300 will be described in detail.

The stepless variable auto stroke hydraulic breaker 300 is provided with a hollow cylinder 301 and a piston 302 that is housed in the cylinder 301 and axially reciprocates in the cylinder 301. The piston 302 is provided with rear guide 304 and front guide 305 that are separated from each other by a circumferential recess 303. First piston face 302*a* and second piston face 302*b* directed to the outside of the circumferential recess 303 define rear cylinder chamber 306 and front cylinder chamber 307, respectively. Here, the first piston face 302*a* has a smaller area than the second piston face 302*b*. Movement of the piston 302 in a forward stroke direction is as indicated by a downward arrow shown in FIG. 7.

The vibration sensor 110 is mounted at one side of an exterior of the cylinder 301. The working mechanism such as the chisel 308 is located at the exterior of the cylinder 301 and is mounted on an end of the piston 302. When a normal operation is performed, i.e., when the chisel 308 does not penetrate a rock to be broken, the piston 302 assumes a typical impact position.

A controller for movement switching of the piston 302 includes a control plunger 309*a* movable in a control valve 309. The control plunger 309*a* is provided with a small control plunger face 309*b* and a large control plunger face 309*c*. The small control plunger face 309*b* is continuously exposed to a working pressure by a resetting conduit 310. The working pressure is generated by a hydraulic pump 311. The first piston face 302*a* is also continuously exposed to the working pressure by a pressure conduit 312 communicating with the resetting conduit 310. An outlet 312*a* of the pressure conduit 312 is disposed at the cylinder 301 such that it is always located in the front cylinder chamber 307.

The large control plunger face 309*c* of the control plunger 309*a* is connected to the cylinder 301 by a switching conduit 313 such that an outlet 313*a* is connected to a reduced pressure return conduit 317 through the circumferential recess 303 in a normal operation state.

One side of the control valve 309 is connected to the pressure conduit 312 by a control conduit 314, and the other side of the control valve 309 is connected to a tank 316 through a return conduit 315. The control valve 309 is connected to the reduced pressure return conduit 317 whose outlet 317*a* is connected to the return conduit 315 through the circumferential recess 303. Therefore, the outlet 317*a* of the reduced pressure return conduit 317 and the outlet 313*a* of the switching conduit 313 are located a distance shorter than an axial length of the circumferential recess 303 away from each other.

Further, the control valve 309 is connected to the rear cylinder chamber 306 by an alternating pressure conduit 318. The second piston face 302*b* is adapted to be exposed to the working pressure that can be supplied to the rear cylinder chamber 306 by the alternating pressure conduit 318.

The control valve 309 can assume two valve positions. That is, the second piston face 302*b* can assume a return stroke position (right side) at which a pressure is reduced through the alternating pressure conduit 318 and the return conduit 315, and a working stroke position (left side) at which the working pressure is applied to the rear cylinder chamber 306 by the pressure conduit 312, the control conduit 314 connected to the pressure conduit 312, and the alternating pressure conduit 318 (left side). As a result of this operation, the piston 302 conducts the working stroke against a resetting force applied to the first piston face 302*a* in a direction of the downward arrow.

Meanwhile, the stepless variable auto stroke hydraulic breaker 300 according to the present invention includes a stroke valve 329 assuming a long stroke position and a short stroke position.

The stroke valve 319 is decided by a pressure applied by a flow rate control valve 320 such as an electric proportional pressure reducing (EPPR) valve or a solenoid valve operated under the control of the reception MCU 240.

An input side of the stroke valve 319 is connected to the pressure conduit 312 by a stroke control pressure conduit 321, and an output side of the stroke valve 319 is connected to the switching conduit 313 for the control valve 309 by an additional conduit 322.

As illustrated, when the flow rate control valve 320 is opened under the control of the reception MCU 240, a large quantity of flow rate is fed to the stroke valve 319 by the hydraulic pump 311, and the piston 302 is operated at a short stroke. When the flow rate control valve 320 is closed under the control of the reception MCU 240, the flow rate fed by the hydraulic pump 311 is interrupted, and the piston 302 is operated at a long stroke.

Here, a reference numeral 323 indicates a spring installed on an upper surface 319*a* of the stroke valve 319. The spring 323 provides a mechanical resetting function according to a change in hydraulic pressure.

Now, an operation of the aforementioned stepless variable auto stroke hydraulic breaker system according to the present invention will be described.

First, it is assumed that, when the reception MCU 240 of the receiver 200 installed in the cabin receives signals of the predetermined number of times, for instance, of 18 times or less, from the vibration sensor 110 for a predetermined time according to a model of the stepless variable auto stroke hydraulic breaker 300, the piston 302 is set to be operated at a short stroke.

When the chisel 208 does not penetrate a rock to be broken after the stepless variable auto stroke hydraulic breaker 300 is activated for work, the stroke of the piston is long, and thus a signal generated from the vibration sensor 110 attached to the transmitter 100 mounted on the attachment does not exceed the predetermined number of times for a predetermined time. This situation is transmitted to the reception antenna 210 of the receiver 200 through the transmission antenna 130 via the transmission signal processor 120 under the control of the transmission MCU 140. The situation received through the reception antenna 210 of the receiver 200 is transmitted to the reception MCU 240 through the reception signal processor 220 for processing it into a reception signal and the reception controller 230 for transmitting the received signal to the reception MCU 240. According to this situation, the reception MCU 240 sends the signal to the flow rate control valve 320 such that the flow rate control valve 320 is opened, and a large quantity of flow rate is fed from the hydraulic pump 311 to the stroke valve 319 and pressurizes a lower side of the stroke valve 319. Thereby, since an area of the lower side of the stroke valve 319 becomes greater than that of an upper side of the stroke valve 319, the stroke valve 319 is switched into an open position (first position), and the piston 302 continues to be operated at a short stroke.

In contrast, when the chisel 208 penetrates a rock to be broken after the stepless variable auto stroke hydraulic breaker 300 is activated for work, the stroke of the piston is short, and thus a signal generated from the vibration sensor 110 attached to the transmitter 100 mounted on the attachment exceeds the predetermined number of times for a predetermined time. The situation is transmitted to the reception antenna 210 of the receiver 200 through transmission antenna 130 via the transmission signal processor 120 under the control of the transmission MCU 140. The situation received through the reception antenna 210 of the receiver 200 is transmitted to the reception MCU 240 through the reception signal processor 220 for processing it into a reception signal and the reception controller 230 for transmitting the received signal to the reception MCU 240. According to this situation, the reception MCU 240 sends the signal to the flow rate control valve 320 such that the flow rate control valve 320 is closed, no flow rate is fed from the hydraulic pump 311 to the stroke valve 319, and the lower side of the stroke valve 319 is not pressurized. Thereby, since the area of the upper side of the stroke valve 319 becomes greater than the area of the lower side of the stroke valve 319, the stroke valve 319 is switched into a closed position (second position), and the piston 302 continues to be operated at a long stroke.

As described above, in the stepless variable auto stroke hydraulic breaker system according to the present invention, the counter 260 of the receiver 200 counts the signals which the vibration sensor 110 attached to the attachment transmits for a predetermined time. If the counted signals do not exceed a predetermined number, the piston 302 is operated at a short stroke. In contrast, if the counted signals exceed a predetermined number, the piston 302 is operated at a long stroke. According to the counted signals, the short stroke is automatically switched into the long stroke, and vice versa.

In the stepless variable auto stroke hydraulic breaker system according to the present invention, according to the number of blows of the chisel, the piston is freely switched between the short stroke and the long stroke. Thus, due to the switching of the strokes, work efficiency is improved. Further, as the stroke is shortened in the event of the idle blow, the remaining impact energy is reduced, and the life of the hydraulic breaker is increased.

Although a preferred embodiment of the present invention has been disclosed for illustrative purposes, those skilled in the art will appreciate that various modifications, additions and substitutions are possible, without departing from the scope and spirit of the invention as disclosed in the accompanying claims. The disclosed embodiments should be taken into consideration not from a limitative point of view but from a descriptive point of view. The scope of the present invention is shown not in the above description but in the claims, and all differences within the range equivalent thereto will be understood to be incorporated in the present invention.

What is claimed is:

1. A stepless variable auto stroke hydraulic breaker system comprising:

a vibration sensor configured to detect vibrations generated when a chisel breaks rocks;

a transmitter provided with the vibration sensor and configured to transmit signals generated from the vibration sensor;

a receiver configured to receive the signals transmitted from the transmitter; and a stepless variable auto stroke hydraulic breaker controlled by a reception micro controller unit (MCU) of the receiver, the stepless variable auto stroke hydraulic breaker comprising:

a cylinder;

a piston that is housed in the cylinder to axially reciprocate in the cylinder and is provided with a first piston face that is directed such that an applied pressure acts in a return stroke direction, a second piston face directed such that the applied pressure acts in a working stroke direction, and a circumferential recess located between the first piston face and the second piston face;

a control valve in which a control plunger is located and which is provided with a small control plunger face for moving the control plunger to a return stroke position and a large control plunger face for moving the control plunger to a working stroke position;

a pressure conduit that provides a working pressure through a first outlet connected to a front chamber of the cylinder;

an alternating pressure conduit that connects the control valve and a second outlet connected to a rear chamber of the cylinder;

a switching conduit that connects the large control plunger face and a third outlet of the cylinder which is located between the first outlet connected to the front chamber and the second outlet connected to the rear chamber;

a reduced pressure return conduit that reduces a pressure through a fourth outlet connected to the cylinder;

a stroke valve, an input side of which is connected to a stroke control pressure conduit, which is directly connected to the pressure conduit connected to a hydraulic pump, an output side of which is connected to the switching conduit for the control valve by an additional conduit connected to the control valve, and a lower side of which is connected to the hydraulic pump by a flow rate control valve operated under the control of the reception MCU; and a spring that is installed on an upper side of the stroke valve to provide a mechanical resetting function according to a change in hydraulic pressure, wherein when the flow rate control valve is closed under the control of the reception MCU and the stroke valve disconnects the stroke control pressure conduit and the additional conduit, the working pressure is provided to the large control plunger face through the third outlet of the switching conduit so that the piston is operated at a long stroke, and wherein when the flow rate control valve is opened under the control of the reception MCU and the stroke valve connects the stroke control pressure conduit and the additional conduit, the working pressure is provided to the large control plunger face through the stroke valve so that the piston is operated at a short stroke.

2. The stepless variable auto stroke hydraulic breaker system according to claim 1, wherein the transmitter includes:

the vibration sensor;

a transmission signal processor for processing the signal generated by the vibration sensor into a transmission signal;

a transmission antenna for transmitting the transmission signal processed by the transmission signal processor; and a transmission MCU for controlling an operation of the transmission signal processor and an operation of the transmission antenna.

3. The stepless variable auto stroke hydraulic breaker system according to claim 1, wherein the vibration sensor includes:

a housing that is formed of a metal;

a protrusion that is formed at an upper end of the housing;

a pair of iron-magnet bias elements that are mounted under the protrusion and provide an electronic element with a predetermined operating point;

a metal cap that covers an upper portion of the housing;

a ceramic insulator that is mounted under the metal cap and adjusts a magnetic field between a magnetic sphere and the metal cap;

a metal electrode that passes through the metal cap and the ceramic insulator to be housed in the housing; and the magnetic sphere that is attached to or detached from the metal electrode to generate a signal.

4. The stepless variable auto stroke hydraulic breaker system according to claim 1, wherein the receiver includes:

a reception antenna that receives a transmission signal transmitted by a transmission antenna of the transmitter;

a reception signal processor that processes the transmission signal received by the reception antenna into a reception signal;

a reception controller that transmits the signal processed by the reception signal processor to the reception MCU;

a light-emitting diode (LED) that emits light to inform an operator of the stepless variable auto stroke hydraulic breaker of a situation received by the reception controller;

a counter that counts a frequency or the number of the vibrations of the vibration sensor under the control of the reception MCU; and the reception MCU that controls operations of the reception antenna, the reception signal processor, the reception controller, the LED, and the counter and controls a hydraulic impact mechanism of the stepless variable auto stroke hydraulic breaker.

* * * * *